US009879588B2

(12) United States Patent
Kamimura

(10) Patent No.: US 9,879,588 B2
(45) Date of Patent: Jan. 30, 2018

(54) ENGINE OIL SUPPLY APPARATUS

(71) Applicant: MAZDA MOTOR CORPORATION, Hiroshima (JP)

(72) Inventor: Keiichi Kamimura, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 23 days.

(21) Appl. No.: 15/022,776

(22) PCT Filed: Aug. 12, 2015

(86) PCT No.: PCT/JP2015/072859
§ 371 (c)(1),
(2) Date: Mar. 17, 2016

(87) PCT Pub. No.: WO2016/039065
PCT Pub. Date: Mar. 17, 2016

(65) Prior Publication Data

US 2016/0230640 A1 Aug. 11, 2016

(30) Foreign Application Priority Data

Sep. 11, 2014 (JP) ..... 2014-185494

(51) Int. Cl.
*F02F 1/00* (2006.01)
*F01P 3/08* (2006.01)
(Continued)

(52) U.S. Cl.
CPC ..... *F01P 3/08* (2013.01); *F01M 1/02* (2013.01); *F01M 1/06* (2013.01); *F01M 1/08* (2013.01);
(Continued)

(58) Field of Classification Search
CPC ..... F01M 11/02; F01M 1/08; F01M 2011/026
(Continued)

(56) References Cited

U.S. PATENT DOCUMENTS 3,416,633 A * 12/1968 Swearingen ..... F16N 39/04
123/196 R
4,523,553 A * 6/1985 Backlund ..... F02B 75/20
123/192.2
(Continued)

FOREIGN PATENT DOCUMENTS

AT 4340 E 10/1981
JP S62-282762 A 12/1987
(Continued)

OTHER PUBLICATIONS

An Office Action issued by the German Patent Office dated May 8, 2017, which corresponds to German Patent Application No. 112015000158.1; with English language translation.
(Continued)

*Primary Examiner* — Marguerite McMahon
*Assistant Examiner* — James Kim
(74) *Attorney, Agent, or Firm* — Studebaker & Brackett PC

(57) ABSTRACT

An engine oil supply apparatus includes: a cylinder block; a shaft supporting member which bears a crank journal of a crank shaft in cooperation with a journal supporting wall section; and a nozzle which injects oil to a piston. The cylinder block includes a first oil supply path which extends in a cylinder bank direction at a position of one side section of the cylinder in a width direction that is perpendicular to the cylinder bank direction, a branch oil path which branches from the first oil supply path at a position of the journal supporting wall section and which supplies oil to a crank bearing section by which the crank journal is borne, and a second oil supply path which extends in the cylinder bank direction at a position further outward than the first oil supply path in the width direction and which supplies oil to the nozzle.

6 Claims, 9 Drawing Sheets

(51) Int. Cl.

| | |
|---|---|
| ***F01M 1/02*** | (2006.01) |
| ***F01M 1/06*** | (2006.01) |
| ***F01M 1/08*** | (2006.01) |
| ***F02F 1/14*** | (2006.01) |
| ***F01M 11/02*** | (2006.01) |

(52) U.S. Cl.
CPC ..... *F01M 11/02* (2013.01); *F02F 1/14* (2013.01); *F01M 2001/086* (2013.01)

(58) Field of Classification Search
USPC ..... 123/193.2, 41.35, 90.12
See application file for complete search history.

(56) References Cited

U.S. PATENT DOCUMENTS 4,690,111 A * 9/1987 Kohno ..... F02F 7/0043 123/192.2
5,517,959 A * 5/1996 Kato ..... F01M 1/02 123/196 AB
5,524,581 A * 6/1996 Rush, II ..... F01M 1/02 123/196 M
5,533,472 A * 7/1996 Sands ..... F01P 3/08 123/41.35
5,690,159 A * 11/1997 Mizukusa ..... B22D 29/00 164/132
2004/0055545 A1* 3/2004 Baldwin ..... F01M 1/08 123/41.35
2008/0066573 A1* 3/2008 Ueshima ..... B22D 23/00 74/609
2011/0253084 A1* 10/2011 Ting ..... F01L 1/267 123/90.16
2011/0276249 A1 11/2011 Argolini et al.
2015/0159525 A1* 6/2015 Matsuda ..... F02B 39/12 123/196 A

FOREIGN PATENT DOCUMENTS

| | | | |
|---|---|---|---|
| JP | H06-346717 | A | 12/1994 |
| JP | H07-180523 | A | 7/1995 |
| JP | H08-100619 | A | 4/1996 |
| JP | H08-144730 | A | 6/1996 |
| JP | 2003-020945 | A | 1/2003 |
| JP | 2007-000923 | A | 1/2007 |
| JP | 2010-071194 | A | 4/2010 |
| JP | 2011-208741 | A | 10/2011 |
| JP | 2014-080888 | A | 5/2014 |
| WO | 81/00881 | A1 | 4/1981 |
| WO | 2010/032118 | A1 | 3/2010 |

OTHER PUBLICATIONS

International Search Report issued in PCT/JP2015/072859; dated Nov. 10, 2015.

* cited by examiner

ENGINE OIL SUPPLY APPARATUS

TECHNICAL FIELD

The present invention relates to an engine oil supply apparatus which supplies oil to respective parts of an engine of an automobile or the like.

BACKGROUND ART

Patent Literature 1 discloses an engine oil supply apparatus in which a main gallery and an oil jet gallery that is connected to the main gallery via a control valve are provided parallel to each other in one side section in a width direction of a cylinder block (a direction perpendicular to a cylinder bank direction). The oil supply apparatus is configured such that oil is supplied to a crank journal of a crank shaft via a supply path that branches from the main gallery and, at the same time, oil is supplied toward a piston sliding section from an oil jet nozzle connected to the oil jet gallery.

In an oil supply apparatus such as that described above, desirably, the respective galleries formed in the cylinder block are rationally arranged from manufacturing and functional perspectives. In addition, since the cylinder block is manufactured by casting, occurrences of molding defects such as blowholes are desirably suppressed in order to contribute towards improving yield.

CITATION LIST

Patent literature

Patent Literature 1: Japanese Unexamined Patent Publication No. H8-144730

SUMMARY OF INVENTION

An object of the present invention is to provide an engine oil supply apparatus that is rationally configured from the perspectives of functions and manufacturing of a cylinder block.

In addition, the present invention is an engine oil supply apparatus including: a cylinder block including a plurality of journal supporting wall sections which are aligned in a cylinder bank direction and each of which supports a crank journal of a crank shaft and a cylinder communicating with a crank chamber formed between the journal supporting wall sections that are adjacent to each other; a shaft supporting member which is assembled to the journal supporting wall section and which bears the crank journal of the crank shall in cooperation with the journal supporting wall section; and a nozzle which is fixed to a ceiling portion of the crank chamber and which injects oil to a piston that slides inside the cylinder, wherein the cylinder block includes a first oil supply path which extends in the cylinder hank direction at a position of one side section of the cylinder in a width direction that is perpendicular to the cylinder hank direction, a branch oil path which branches from the first oil supply path at a position of the journal supporting wall section and which supplies oil to a crank hearing section by which the crank journal is home, and a second oil supply path which extends in the cylinder hank direction at a position further outward than the first oil supply path in the width direction and which supplies oil to the nozzle.

DESCRIPTION OF EMBODIMENTS

Hereinafter, a preferred embodiment of the present invention will be described in detail with reference to the accompanying drawings.

<Configuration of Engine>

Figure 1:
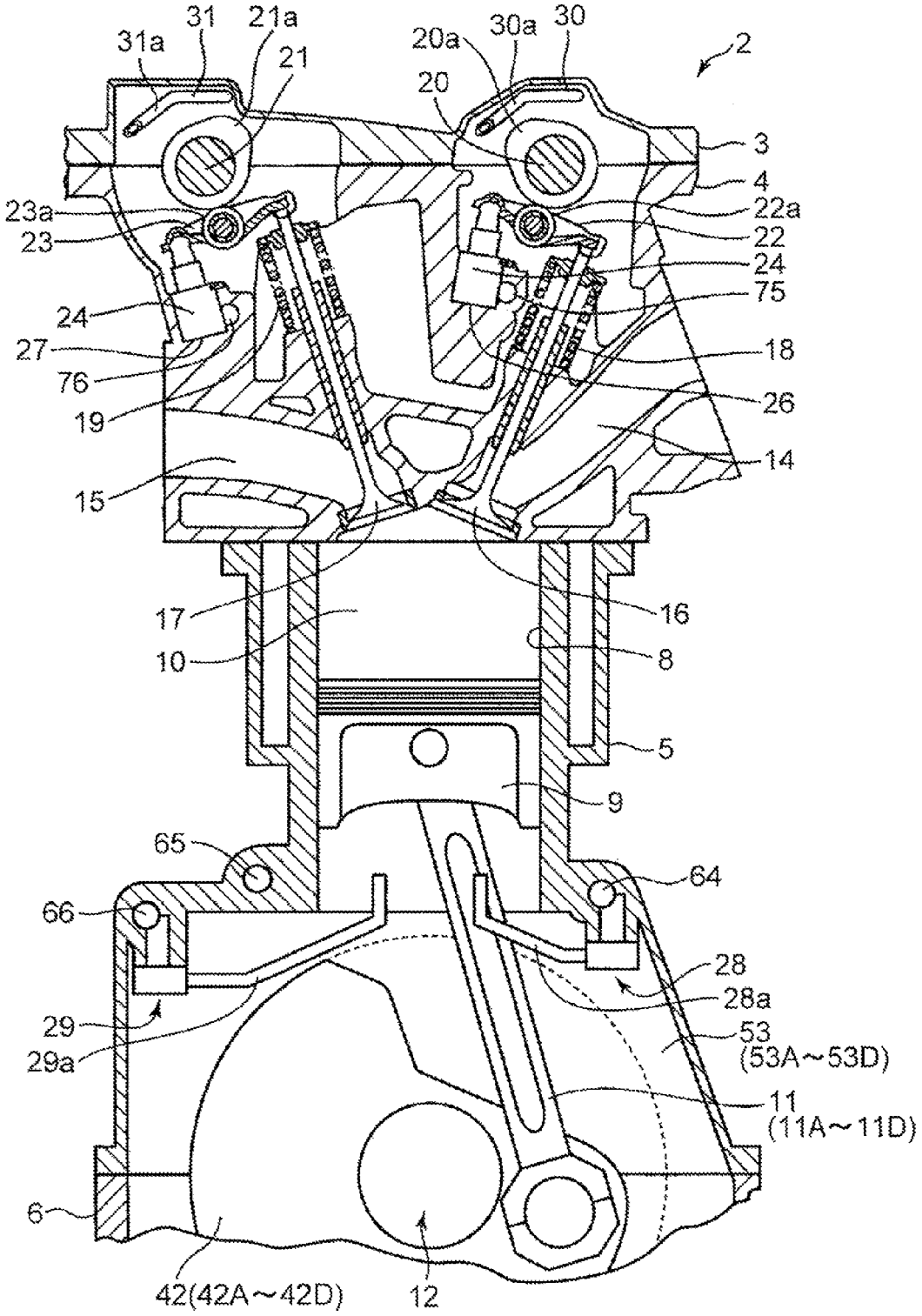
FIG. 1 is a sectional view showing a schematic configuration of a multi-cylinder engine to which an oil supply apparatus according to the present invention is applied.

FIG. 1 shows a multi-cylinder engine 2 (hereinafter, simply referred to as an engine 2) to which an oil supply apparatus according to the present invention is applied. The engine 2 is an in-line four-cylinder gasoline engine in which a first cylinder #1 to a fourth cylinder #4 are arranged in order in a straight row in a direction perpendicular to a paper plane of FIG. 1 and which is mounted to a vehicle such as an automobile.

Figure 5:
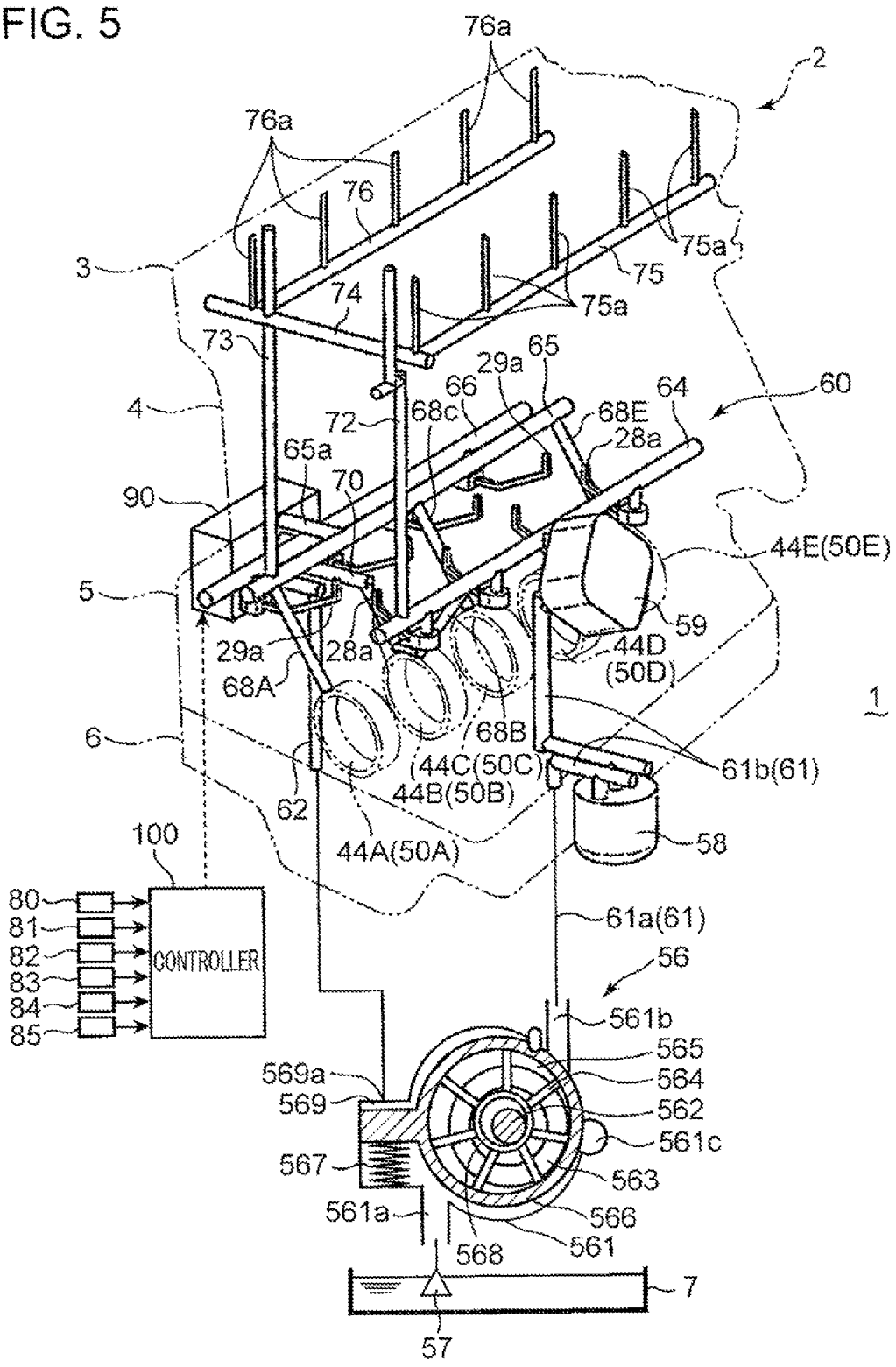
FIG. 5 is a schematic view showing an overall configuration of an oil supply apparatus.

The engine 2 includes a vertically coupled cam cap 3, a cylinder head 4, a cylinder block 5, a crank case 6, and an oil pan 7 (refer to FIG. 5). Four cylinder bores 8 are formed in the cylinder block 5, and a piston 9 is slidably housed in each of the cylinder bores 8. The piston 9, the cylinder bore 8, and the cylinder head 4 form a combustion chamber 10 for each cylinder. Moreover, each piston 9 is coupled via a connecting rod 11 to a crank shaft 12 which is rotatably supported by the cylinder block 5 and the like.

An intake port 14 and an exhaust port 15 which open to the combustion chamber 10 are provided on the cylinder head 4, and an intake valve 16 and an exhaust valve 17 which respectively open and close the intake port 14 and the exhaust port 15 are respectively mounted to the ports 14 and 15.

The intake valve 16 and the exhaust valve 17 are respectively biased in a direction that closes the respective ports 14 and 15 (an upward direction in FIG. 1) by return springs 18 and 19, and are configured to open the respective ports 14 and 15 by being pressed down by cam sections 20*a* and 21*a* provided on outer peripheries of cam shafts 20 and 21. Specifically, with a rotation of the cam shafts 20 and 21, the cam sections 20*a* and 21*a* press down on cam followers 22*a* and 23*a* provided in approximately central portions of swing anus 22 and 23, and the swing arms 22 and 23 swing with a vertex of a pivot mechanism of a hydraulic lash adjuster (hereinafter, referred to as HLA) 24 provided an one end side of the swing arms 22 and 23 as a fulcrum. In accordance with the swinging, other end sections of the swing arms 22 and 23 press down on the intake valve 16 and the exhaust valve 17 against biasing forces of the return springs 18 and 19. As a result, the respective ports 14 and 15 are opened.

In the cylinder head 4, portions on an intake side and an exhaust side which correspond to each of the four cylinders are provided with mounting holes 26 and 27 to which the HLAs 24 are inserted and mounted. In addition, oil paths 75 and 76 which respectively communicate with the mounting holes 26 and 27 of the intake-side and exhaust-side HLAs 24 are formed in the cylinder head 4 so as to extend in a cylinder bank direction across the first to fourth cylinders. The oil paths 75 and 76 supply oil (operating oil) to the pivot mechanisms of the HLAs 24 mounted to the mounting holes 26 and 27, and the pivot mechanisms of the HLAs 24 automatically adjust valve clearance to zero using oil pressure (working pressure) of the oil.

In the cylinder block 5, a main gallery 64 (which corresponds to the main oil supply path according to the present invention) extending in the cylinder bank direction is provided inside a side wall on one side (intake side) of the cylinder bore 8 in the width direction of the cylinder block 5, and a pair of sub galleries 65 and 66 (which correspond to the first oil supply path and the second oil supply path/the first sub oil supply path and the second sub oil supply path according to the present invention) which are aligned at prescribed intervals in the width direction of the cylinder block 5 and which respectively extend in the cylinder bank direction are provided inside a side wall on another side (exhaust side) of the cylinder bore 8 in the width direction of the cylinder block 5. The respective galleries 64 to 66 are oil paths for supplying oil to be described in detail later.

An oil jet 28 for piston cooling which communicates with the main gallery 64 is provided at a position which is below the main gallery 64 and which corresponds to each piston 9. Meanwhile, an oil jet 29 for piston lubrication which communicates with the sub gallery 66 among the sub galleries 65 and 66 is provided at a position which is in a vicinity of a lower side of the sub gallery 66 that is positioned on an outer side in the width direction of the cylinder block 5 and which corresponds to each piston 9 (refer to FIGS. 7 and 8).

Among the oil jets 28 and 29, the oil jet 28 for piston cooling has a nozzle 28*a* that is fixed at a position further toward an intake side than the cylinder bore 8 on a ceiling surface of a crank chamber 53, and the oil jet 28 is configured to inject oil (cooling oil) in a shower-like pattern toward mainly a central part of a rear surface of the piston 9 from the nozzle 28*a*. On the other hand, the oil jet 29 for piston lubrication has a nozzle 29*a* that is fixed at a position separated from the cylinder bore 8 toward an exhaust side on the ceiling surface of the crank chamber 53, and the oil jet 29 is configured to inject oil (lubricating oil) at a narrower angle than the oil jet 28 for piston cooling mainly toward a rear surface of a skirt section of the piston 9 from the nozzle 29*a*. A passage for guiding oil is formed on the skirt section of the piston 9 and oil injected from the nozzle 29*a* is guided to a piston sliding surface through the passage.

In addition, oil supply sections 30 and 31 are provided above the respective cam shafts 20 and 21. The oil supply sections 30 and 31 have nozzles 30*a* and 31*a* and are configured so that oil (lubricating oil) drips down from the nozzles 30*a* and 31*a* to the cam sections 20*a* and 21*a* of the cam shafts 20 and 21 and to contact sections between the swing suns 22 and 23 and the cam followers 22*a* and 23*a* which are positioned below the nozzles 30*a* and 31*a*. Moreover, although not shown, a hydraulic-operated variable valve timing mechanism (VVT) is built into the engine 2 and changes opening and closing timings of the intake and exhaust valves 16 and 17 in accordance with an operation state of the engine 2.

Figure 2:
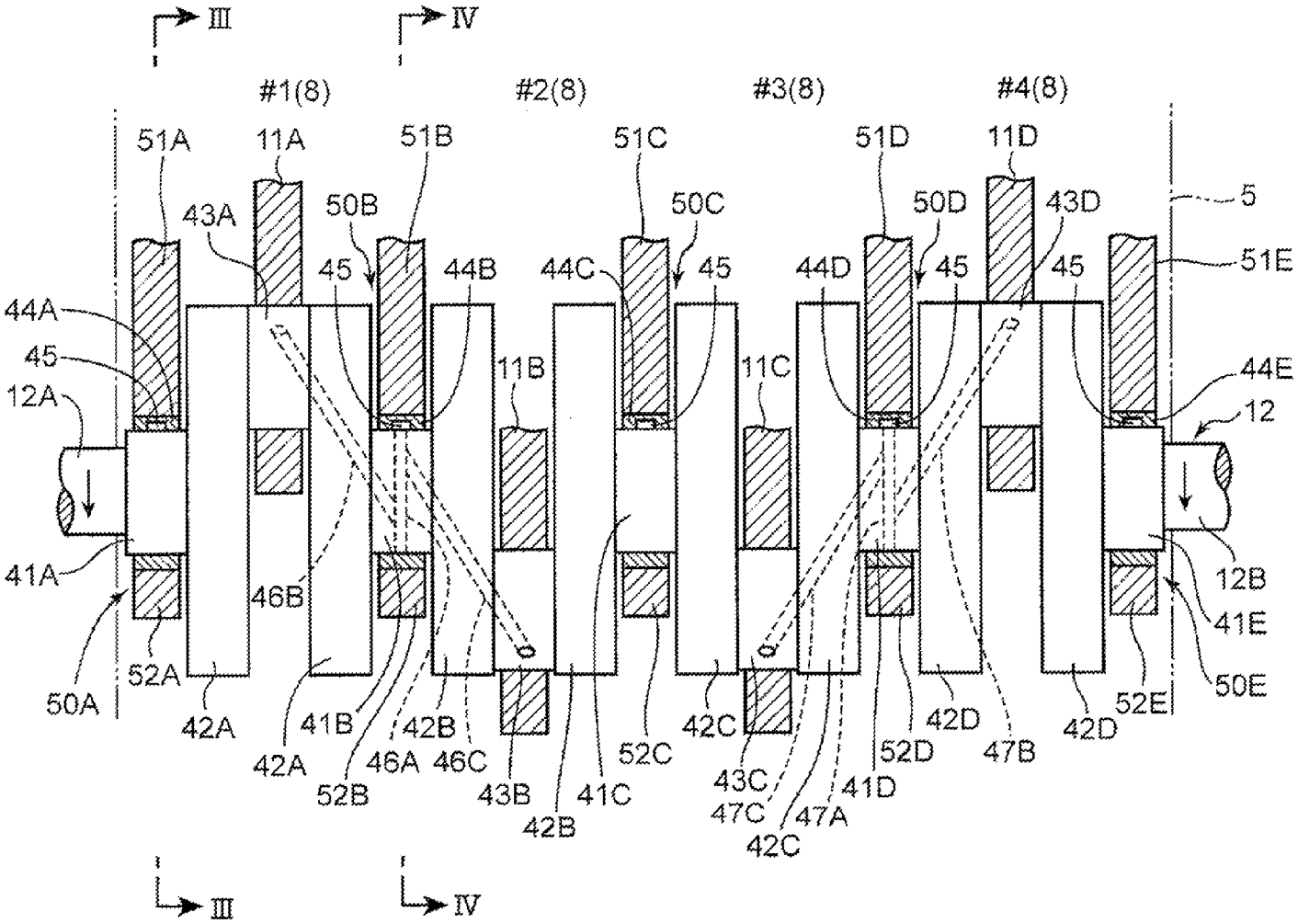
FIG. 2 is a vertical sectional view showing a detailed structure of a bearing portion of a crank shaft.

FIG. 2 shows a detailed structure of a bearing portion of the crank shaft 12 described above as a vertical sectional view.

From left to right in FIG. 2, the crank shaft 12 includes a first journal (crank journal) 41A adjacent to a front-side end section 12A of the crank shall 12, a second journal 41B positioned between the first cylinder #1 and the second cylinder #2, a third journal 41C positioned between the second cylinder #2 and the third cylinder #3, a fourth journal 41D positioned between the third cylinder #3 and the fourth cylinder #4, and a fifth journal 41E adjacent to a rear-side end section 12B of the crank shaft 12.

A pair of first crank webs (crank weights) 42A and a first crank pin 43A are provided between the first journal 41A and the second journal 41B, a pair of second crank webs 42B and a second crank pin 43B are provided between the second journal 41B and the third journal 41C, a pair of third crank webs 42C and a third crank pin 43C are provided between the third journal 41C and the fourth journal 4D, and a pair of fourth crank webs 42D and a fourth crank pin 43D are provided between the fourth journal 41D and the fifth journal 41E.

In addition, a first connecting rod 11A that is coupled to the piston 9 of the first cylinder #1 is home by the first crank pin 43A, a second connecting rod 11B that is coupled to the piston 9 of the second cylinder #2 is borne by the second crank pin 43B, a third connecting rod 11C that is coupled to the piston 9 of the third cylinder #3 is borne by the third crank pin 43C, and a fourth connecting rod 11D that is coupled to the piston 9 of the fourth cylinder #4 is borne by the fourth crank pin 43D.

The cylinder block 5 is provided with bearing sections that support the five journals 41A to 41E. Specifically, the bearing sections include a first hearing section 50A that supports the first journal 41A, a second bearing section 50B that supports the second journal 41B, a third beating section 50C that supports the third journal 41C, a fourth bearing section 50D that supports the fourth journal 41D, and a fifth beating section 50E that supports the fifth journal 41E. In the present example, the bearing sections 50A to 50E correspond to crank bearing sections according to the present invention.

The respective bearing sections 50A to 50E include cylindrical bearing metals 44A to 44E (a first hearing metal 44A to a fifth bearing metal 44E) which have inner peripheral surfaces that oppose outer peripheral surfaces of the journals 41A to 41E, and bear the journals 41A to 41E with the bearing, metals 44A to 44E by surface bearing.

The first bearing metal 44A provided in the first bearing section 50A is fixed between a first block-side supporting section 51A of the cylinder block 5 and a first bearing cap 52A that is coupled to the first block-side supporting section 51A. The second bearing metal 44B provided in the second bearing section 50B is fixed between a second block-side supporting section 51B of the cylinder block 5 and a second hearing cap 52B that is coupled to the second block-side supporting section 51B. The third bearing metal 44C provided in the third bearing section 50C is fixed between a third block-side supporting section 51C of the cylinder block 5 and a third bearing cap 52C that is coupled to the third block-side supporting section 51C. The fourth hearing metal 44D provided in the fourth bearing section 50D is fixed between a fourth block-side supporting section 51D of the cylinder block 5 and a fourth bearing cap 52D that is coupled to the fourth block-side supporting section 51D. The fifth bearing metal 44E provided in the fifth bearing section 50E is fixed between a fifth block-side supporting section 51E of the cylinder block 5 and a fifth bearing cap 52E that is coupled to the fifth block-side supporting section 51E.

Figure 8:
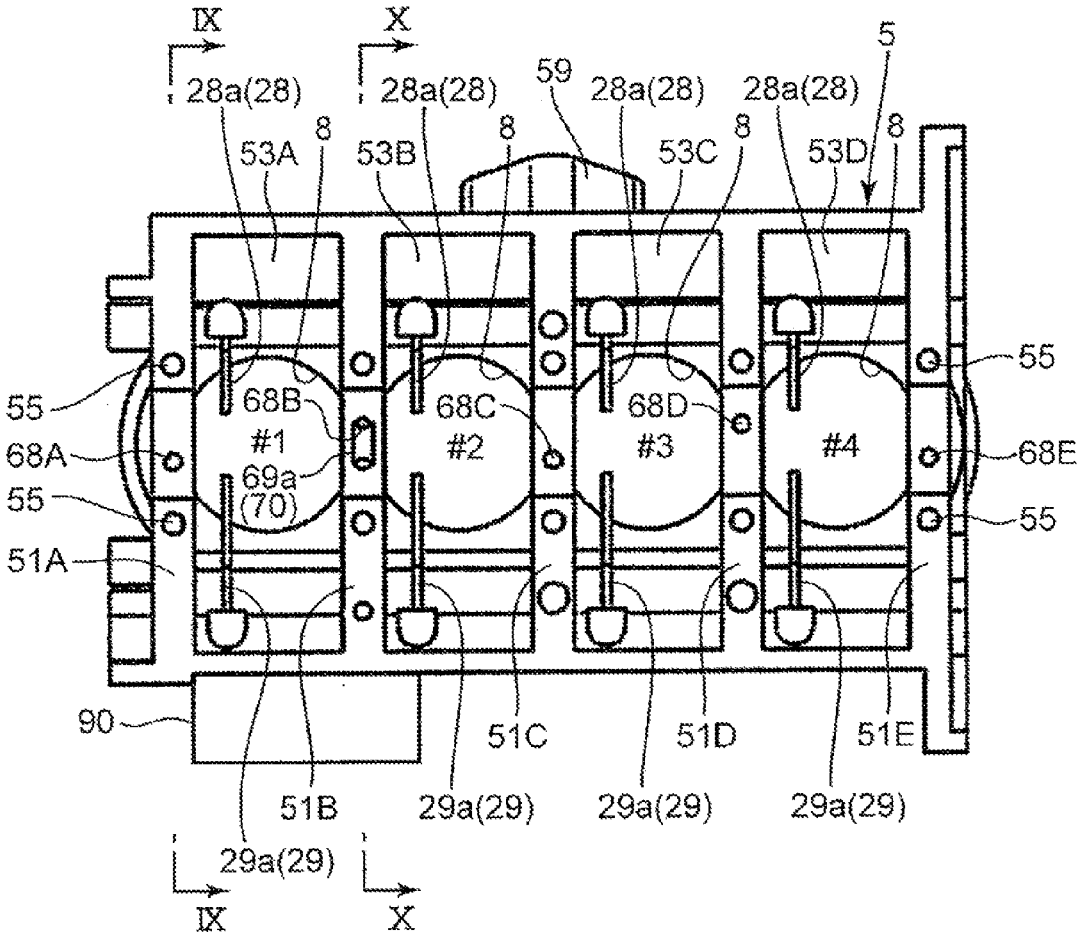
FIG. 8 is a lower view showing a cylinder block.

As shown in FIG. 8, the block-side supporting sections 51A to 51E are partitions that form crank chambers 53A to 53D which respectively correspond to the first cylinder #1 to the fourth cylinder #4 thrilled in the cylinder block 5 and are aligned at intervals corresponding to the journals 41A to 41E in the cylinder hank direction. In the present example, the block-side supporting sections 51A to 51E correspond to the journal supporting wail sections according to the present invention and the bearing caps 52A to 52E correspond to the shaft supporting members according to the present invention.

The respective bearing metals 44A to 44E are made up of an arc-shaped upper metal and an arc-shaped lower metal. The upper metal and the lower metal combine to form a cylindrical shape (refer to FIGS. 3 and 4). In addition, the bearing metals 44A and 44E are respectively arranged between an arc-shaped surface formed on the respective block-side supporting sections 51A to 51E and an arc-shaped surface formed on the respective bearing caps 52A to 52E and are sandwiched from both upper and lower sides by the block-side supporting sections 51A to 51E and the bearing caps 52A to 52E.

Figure 3:
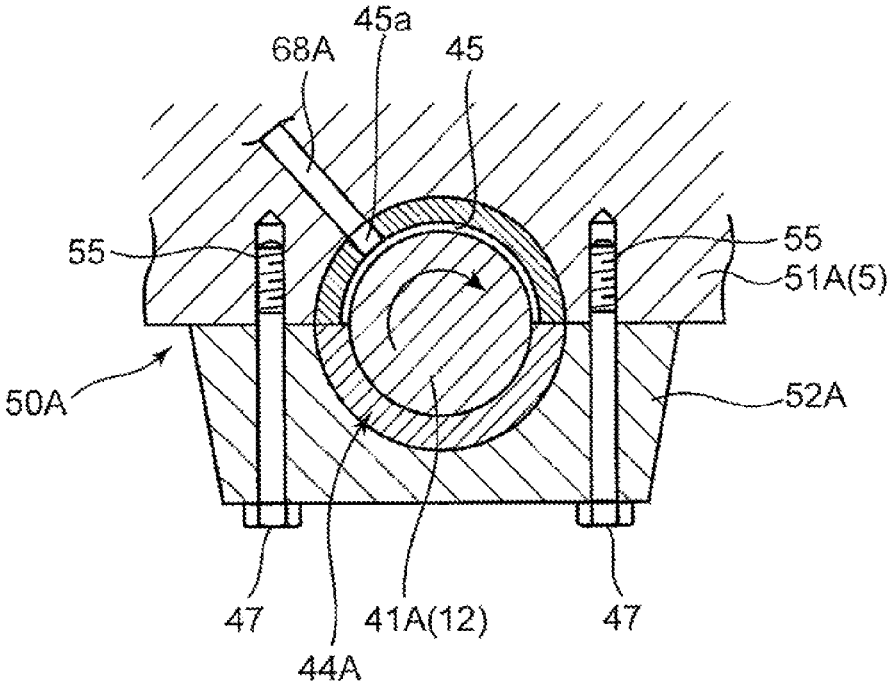
FIG. 3 is a vertical sectional view showing a first bearing section (a sectional view taken along line III-III in FIG. 2).
Figure 4:
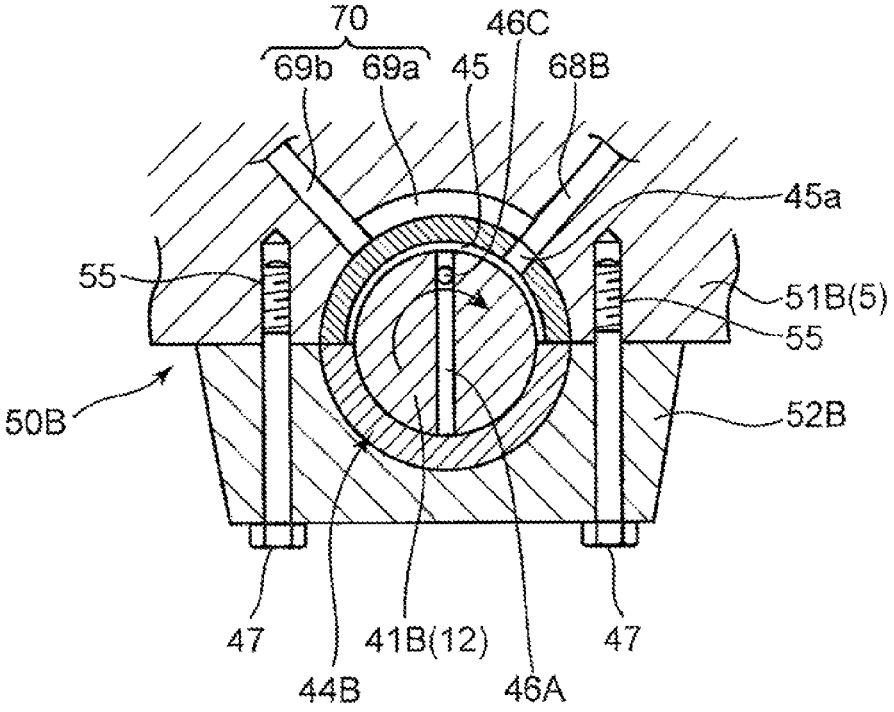
FIG. 4 is a vertical sectional view showing a second bearing section (a sectional, view taken along line IV-IV in FIG. 2).

Moreover, as shown in FIGS. 3 and 4, the respective bearing caps 52A to 52E are respectively coupled by a bolt 47 to the block-side supporting sections 51A to 51E at positions on both sides of the respective journals 41A to 41E. Specifically, a pair of screw holes 55 is formed on both sides of the arc-shaped surfaces (bearing surfaces of the respective bearing metals 44A to 44E) which are lower surfaces of the respective block-side supporting sections 51A to 51E. In addition, as the bolt 47 is inserted from below through a through-hole formed on the respective bearing caps 52A to 52E and screwed and inserted to the screw hole 55, the respective bearing caps 52A to 52E are respectively coupled to the block-side supporting sections 51A to 51E.

Although a detailed description, will be given later, a first supply oil path 68A to a fifth supply oil path 68E which respectively supply oil to the bearing sections 50A to 50E at positions of the respective block-side supporting sections 51A to 51E are formed in the cylinder block 5 (refer to FIGS. 5 and 6).

As shown in FIGS. 2 to 4, an oil groove 45 which stores oil supplied through the respective supply oil paths 68A to 68E is provided in a peripheral direction, and an oil supply hole 45*a* for receiving oil to the oil groove 45 is formed on an inner peripheral surface of the upper metal of the respective bearing metals 44A to 44E.

In addition, a first inside oil path 46A, a second inside oil path 46B, and a third inside oil path 46C are integrally and communicatively formed inside the crank shaft 12 from the first crank pin 43A, the first crank web 42A, the second journal 41B, the second crank web 42B, to the second crank pin 43B. In a similar manner, a first inside oil path 47A, a second inside oil path 47B, and a third inside oil path 47C are integrally and communicatively formed inside the crank shaft 12 from the fourth crank pin 43D, the fourth crank web 42D, the fourth journal 41D, the third crank web 42C, to the third crank pin 43C. Moreover, in the present example, the inside oil paths 46A to 46C and 47A to 47C correspond to the inside passages according to the present invention.

One first inside oil path 46A penetrates the second journal 41B in a diameter direction and communicates with the oil groove 45. The second inside oil path 46B having branched from the first inside oil path 46A is opened to an outer peripheral surface of the first crank pin 43A and the third inside oil path 46C having branched from the first inside oil path 46A is opened to an outer peripheral surface of the second crank pin 43B (refer to FIG. 2). The other first inside oil path 47A penetrates the fourth journal 41D in a diameter direction and communicates with the oil groove 45. In addition, the second inside oil path 47B having branched from the first inside oil path 47A is opened to an outer peripheral surface of the fourth crank pin 43D and the third inside oil path 47C having branched from the first inside oil path 47A is opened to an outer peripheral surface of the third crank pin 43C (refer to FIG. 2).

In other words, the inside oil paths 46A to 46C positioned to the front of the crank shaft 12 supply oil which is supplied to the second bearing section 50B provided with the second bearing metal 44B through the second supply oil path 68B to the first crank pin 43A which bears the first connecting rod 11A and to the second crank pin 43B which bears the second connecting rod 11B. On the other hand, the inside oil paths 47A to 47C positioned to the rear of the crank shaft 12 supply oil which is supplied to the fourth bearing section 50D provided with the fourth bearing metal 44D through the fourth supply oil path 68D to the fourth crank pin 43D which bears the fourth connecting rod 11D and to the third crank pin 43C which bears the third connecting rod 11C.

<Description of Oil Supply Apparatus>

Next, the oil supply apparatus 1 for supplying oil (operating oil) to respective hydraulic operating sections of the engine 2 will be described in detail with reference to FIG. 5. "Hydraulic operating sections" refer to apparatuses (the HLAs 24, the VVT, and the like) which are driven by receiving oil pressure of oil or to oil supply sections (the oil jets 28 and 29, the oil supply sections 30 and 31, and the like) which supply oil using its of pressure to an object as lubricating oil or cooling oil.

As illustrated, the oil supply apparatus 1 includes an oil pump 56 that is driven by rotation of the crank shaft 12 and an oil supply path 60 which is connected to the oil pump 56 and which guides oil pressurized by the oil pump 56 to the respective hydraulic operating sections of the engine 2. Moreover, the oil pump 56 is an auxiliary machine driven by the engine 2.

The oil pump 56 according to the present embodiment is a known variable displacement oil pump. The oil pump 56 includes: a housing 561 that is made up of a pump body with a C-shaped section which is formed so that one end side is opened and which internally includes a pump housing chamber constituted by a columnar space and a cover member which closes the opening of the pump body; a driving shaft 562 which is rotatably supported by the housing 561, which penetrates an approximately central part of the pump housing chamber, and which is rotationally driven by the crank shaft 12; a pump element that is made up of a rotor 563 which is rotatably housed inside the pump housing chamber and whose central part is coupled to the driving shaft and vanes 564 which are respectively retractably housed in a plurality of slits that are radially cut and formed in an outer peripheral section of the rotor 563; a cam ring 566 which is eccentrically arranged with respect to a center of rotation of the rotor 563 on an outer peripheral side of the pump element and which defines pump chambers 565 that are a plurality of operating oil chambers together with the rotor 563 and adjacent vanes 564; a spring 567 that is a biasing member which is housed in the pump body and which constantly biases the cam ring 566 in a direction in which an amount of eccentricity of the cam ring 566 with respect to the center of rotation of the rotor 563 increases; and a pair of ring members 568 which is slidably arranged in both side sections on an inner peripheral side of the rotor 563 and which has a smaller diameter than the rotor 563. The housing 561 includes an inlet 561*a* which supplies oil to the internal pump chamber 565 and an discharge port 561*b* which discharges oil from the pump chamber 565. A pressure chamber 569 which is defined by an inner peripheral surface of the housing 561 and an outer peripheral surface of the cam ring 566 is formed inside the housing 561, and the housing 561 is provided with an introduction hole 569*a* that opens to the pressure chamber 569. In other words, the oil pump 56 is configured such that, when of is introduced to the pressure chamber 569 from the introduction hole 569*a*, the cam ring 566 swings with respect to a fulcrum 561*c*, the rotor 563 becomes relatively eccentric with respect to the cam ring 566, and discharge capacity changes.

An oil strainer 57 which faces the oil pan 7 is coupled to the inlet 561*a* of the oil pump 56. An oil filter 58 and an oil cooler 59 are arranged in order from an upstream side in an oil path 61 which communicates with the discharge port 561*b* of the oil pump 56. Oil stored in the oil pan 7 is pumped by the oil pump 56 through the oil strainer 57, filtered by the oil filter 58, cooled by the oil cooler 59, and subsequently introduced to the main gallery 64 (to be described below) in the cylinder block 5. Moreover, in FIG. 5, the oil pump 56 and the oil pan 7 are illustrated separately from the engine 2 for the sake of convenience.

An oil path 62 which introduces oil from the main gallery 64 to the pressure chamber 569 of the oil pump 56 is connected to the oil pump 56. A second oil control valve 93 (to be described later) constituted by a linear solenoid valve is provided between the oil path 62 and the main gallery 64. A capacity of the oil pump 56 changes as an oil flow rate (oil pressure) introduced to the pressure chamber 569 is changed by the second oil control valve 93.

The oil supply path 60 is made up of passages formed in the cylinder head 4, the cylinder block 5, the crank case 6, and the like as well as pipes. Moreover, in the following description, the cylinder head 4, the cylinder block 5, and the crank, case 6 will be referred to as an engine main body when appropriate.

Figure 6:
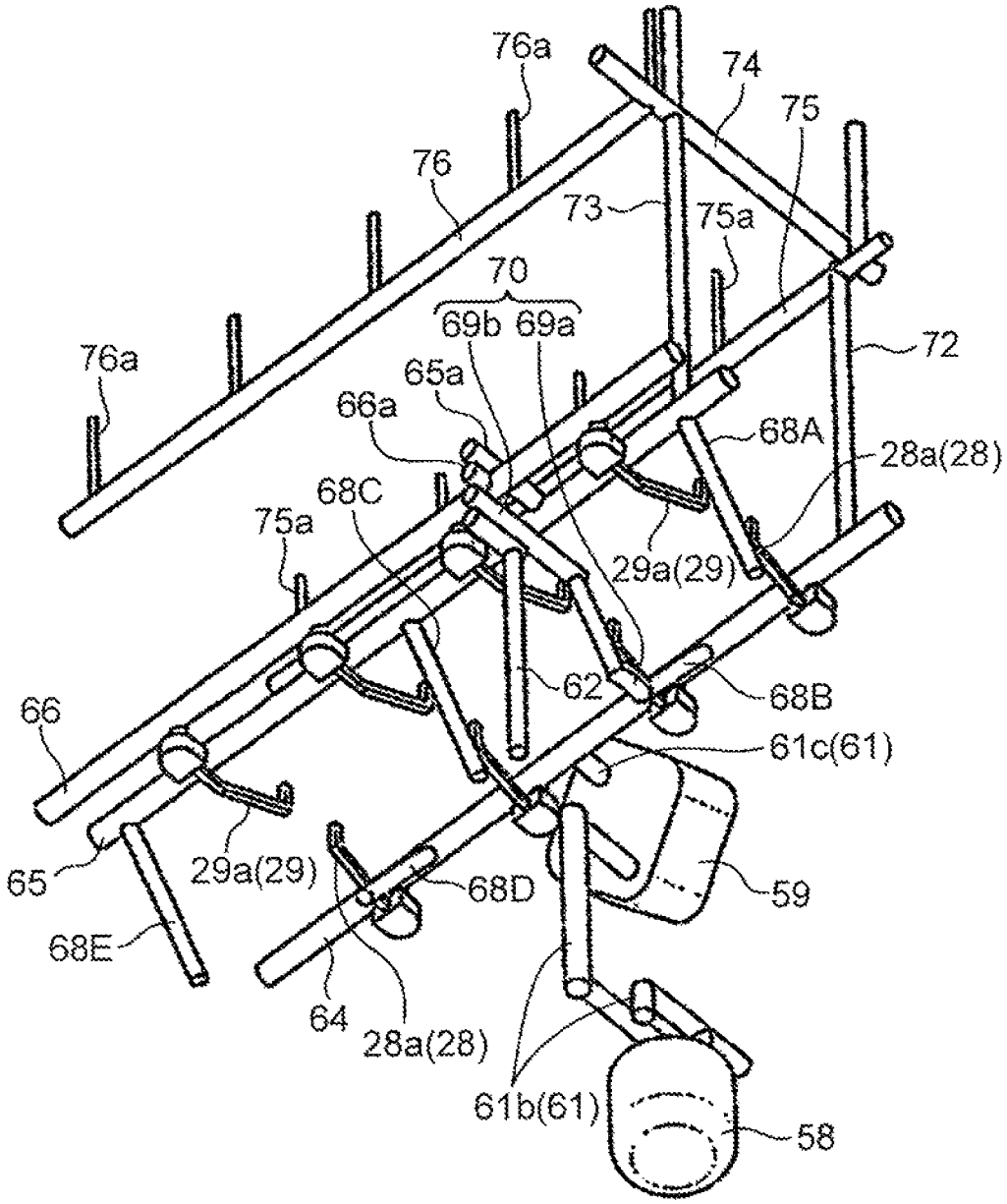
FIG. 6 is a schematic view solely showing an oil supply path (in a state where the oil supply path is viewed from diagonally below an engine).

As shown in FIGS. 5 and 6, the oil supply path 60 includes: the upstream-side main gallery 64 for mainly guiding oil to hydraulic operating sections with high required pressure among the hydraulic operating sections; the pair of downstream-side sub galleries 65 and 66 for guiding oil to hydraulic operating sections with relatively low required pressure (hydraulic operating sections whose required pressure is lower than the hydraulic operating sections to which oil is directly supplied from the main gallery); the oil path 61 for oil introduction which guides oil discharged from the oil pump 56 to the main gallery 64 via the oil filter 58 and the oil cooler 59; the oil path 62 which extracts au from the main gallery 64 and which guides oil for pump control to the pressure chamber 569 of the oil pump 56; and various oil paths branched from the main gallery 64 and the like.

The oil path 61 includes: a pipe 61*a* which connects the discharge port 561*b* of the oil pump 56 and a port portion of the crank case 6 to each other; a passage 61*b* which is formed in the engine main body so as to reach the oil cooler 59 that is fixed to a side surface (an intake-side side surface) of the cylinder block 5 from the port portion via the oil filter 58 fixed on a side portion (an intake-side side surface) of the crank case 6; and a passage 61*c* which connects the oil cooler 59 and the main gallery 64 to each other.

As shown in FIGS. 1 and 5, the main gallery 64 is provided in the cylinder block 5 at a position which is more outward (more toward an intake side) than the cylinder bore 8 in a width direction of the cylinder block 5 and which is in a vicinity of a lower end section of the cylinder bore 8. The main gallery 64 extends in a cylinder bank direction. Meanwhile, the sub galleries 65 and 66 (referred to as a first sub gallery 65 and a second sub gallery 66) are respectively provided in the cylinder block 5 on an opposite side to the main gallery 64 with the cylinder bore 8 as center so that the second sub gallery 66 is positioned more outward in the width direction of the cylinder block 5 (more toward a side opposite to the cylinder bore 8) than the first sub gallery 65. The sub galleries 65 and 66 are aligned at a prescribed interval in the width direction of the cylinder block 5. The respective galleries 64 to 66 including the main gallery 64 extend horizontally in a straight line in the cylinder bank direction so as to be parallel to each other.

Oil supply paths which respectively branch from the main gallery 64 and the first sub gallery 65 and which supply oil to the bearing sections 50A to 50E are formed in the cylinder block 5.

Specifically, as shown in FIGS. 5 and 6, the first supply oil path 68A, the third supply oil path 68C, and the filth supply oil path 68E which respectively branch from the first sub gallery 65 and which reach the first bearing section 50A, the third hearing section 50C, and the fifth bearing section 50D are formed in the cylinder block 5. Also, the second supply oil path 68B and the fourth supply oil path 68D which respectively branch from the main gallery 64 and which reach the second bearing section 50B and the fourth beating section 50D are formed in the cylinder block 5. In the present example, the supply oil paths 68A, 68C, and 68E correspond to the first branch oil paths according to the present invention and the supply oil paths 68B and 68D correspond to the second branch oil paths according to the present invention.

Figure 9:
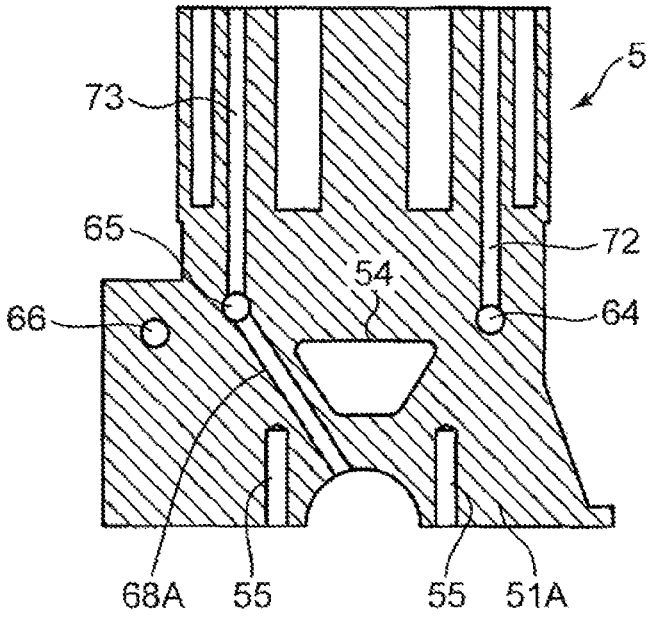
FIG. 9 is a sectional view of a cylinder block (a sectional view taken along line IX-IX in FIG. 8).

As shown in FIGS. 8 and 9, the first supply oil path 68A is formed in the first block-side supporting section 51A of the cylinder block 5. The first supply oil path 68A branches from the second sub gallery 66 at a position of the first block-side supporting section 51A in the cylinder bank direction and extends diagonally downward from the second sub gallery 66 toward the first bearing section 50A. In addition, as shown in FIG. 3, the first supply oil path 68A opens to the arc-shaped surface of the first block-side supporting section 51A which supports the first bearing metal 44A at a position opposing an outer peripheral surface of the first bearing metal 44A. Accordingly, oil is supplied to the oil groove 45 of the first bearing metal 44A from the first sub gallery 65 through the first supply oil path 68A. Moreover, the oil supply hole 45*a* of the first hearing metal 44A is formed at a position opposing the that supply oil path 68A.

Although not illustrated, the third supply oil path 68C is formed in the third block-side supporting section 51C in a similar manner to the first supply oil path 68A, and the fifth supply oil path 68E is formed in the fifth block-side supporting section 51E in a similar manner. Moreover, reference numeral 54 in FIGS. 9 and 10 denotes an opening formed on the block-side supporting sections 51A to 51E and adjacent crank chambers 53A to 53D communicate with each other through the opening 54.

Figure 10:
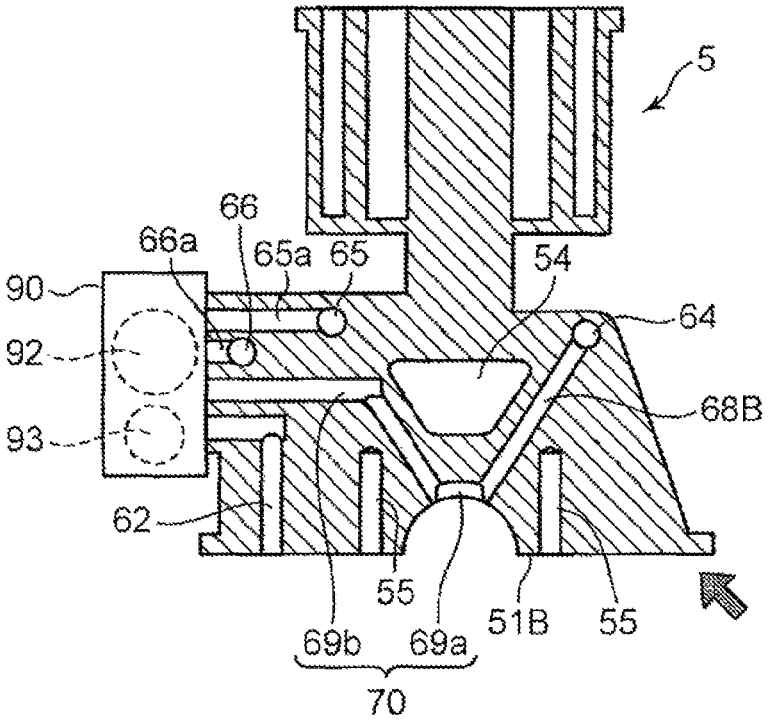
FIG. 10 is a sectional view of a cylinder (a sectional view taken along line X-X in FIG. 8).

On the other hand, as shown in FIGS. 8 and 10, the second supply oil path 68B is formed in the second block-side supporting section 51B of the cylinder block 5. The second supply oil path 68B branches from the main gallery 64 at a position of the second block-side supporting section 51B in the cylinder bank direction and extends diagonally downward from the main gallery 64 toward the second bearing section 50B. In addition, as shown in FIG. 4, the second supply oil path 68B opens to the arc-shaped surface of the second block-side supporting section 51B which supports the second hearing metal 44B at a position opposing an outer peripheral surface of the second bearing metal 44B. Accordingly, oil is supplied to the oil groove 45 of the second bearing metal 44B from the main gallery 64 through the second supply oil path 68B. Moreover, the oil supply hole 45*a* of the second bearing metal 44B is formed at a position opposing the second supply oil path 68B.

Although not illustrated, the fourth supply oil path 68D is formed in the fourth block-side supporting section 51D in a similar manner to the second supply oil path 68B.

A relay oil path 70 for connecting the main gallery 64 and the sub galleries 65 and 66 to each other in the width direction of the cylinder block as shown in FIGS. 4 and 10 is further formed in the second block-side supporting section 51B. As shown, the relay oil path 70 is made up of: a groove-like oil path 69*a* which extends in a peripheral direction along an outer peripheral surface of the second bearing metal 44B and whose one end portion communicates with the second supply oil path 68B; and an oil path 69*b* which communicates with the oil path 69*a* at another end portion of the oil path 69*a*, which extends diagonally upward from the other end portion of the oil path 69*a* toward a position of the first sub gallery 65, which bends at a position slightly below the first sub gallery 65 and passes a position below the second sub gallery 66, and which opens to an exhaust-side side surface of the cylinder block 5.

Figure 7:
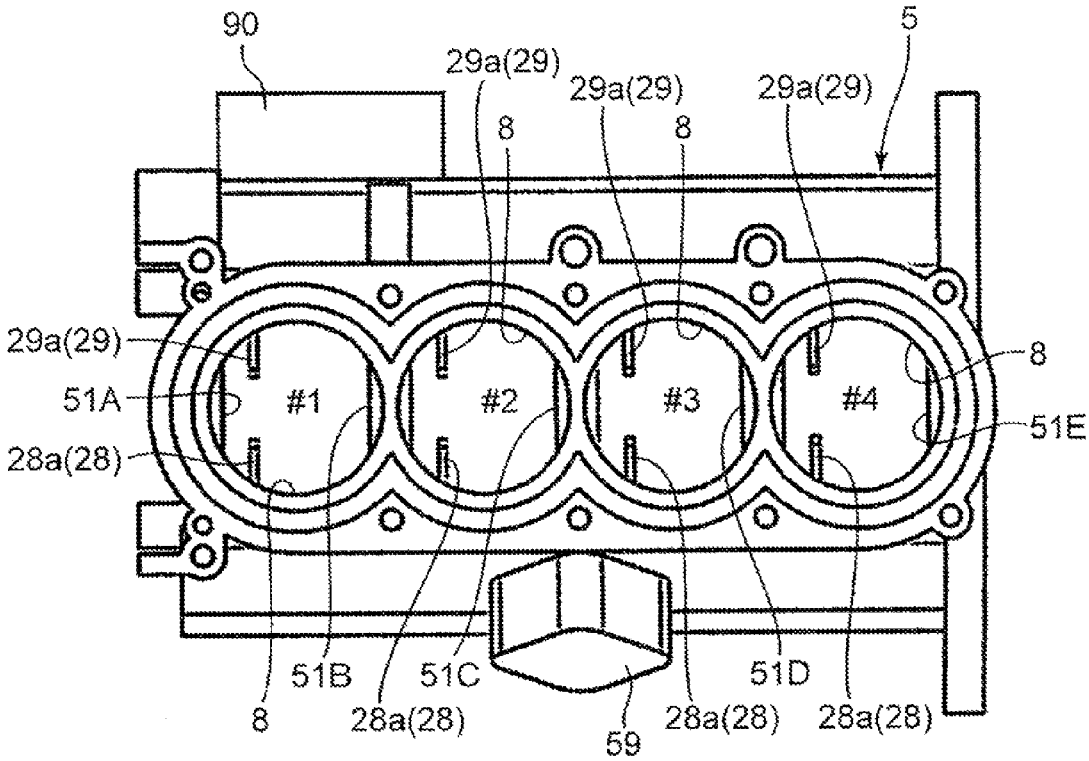
FIG. 7 is a plan view showing a cylinder block.

An OCV (oil control valve) unit 90 is fixed to a region which is the exhaust-side side surface of the cylinder block 5 and which ranges from the second block-side supporting section 51B to the first block-side supporting section 51A (refer to FIGS. 5, 7, and 8).

Figure 11:
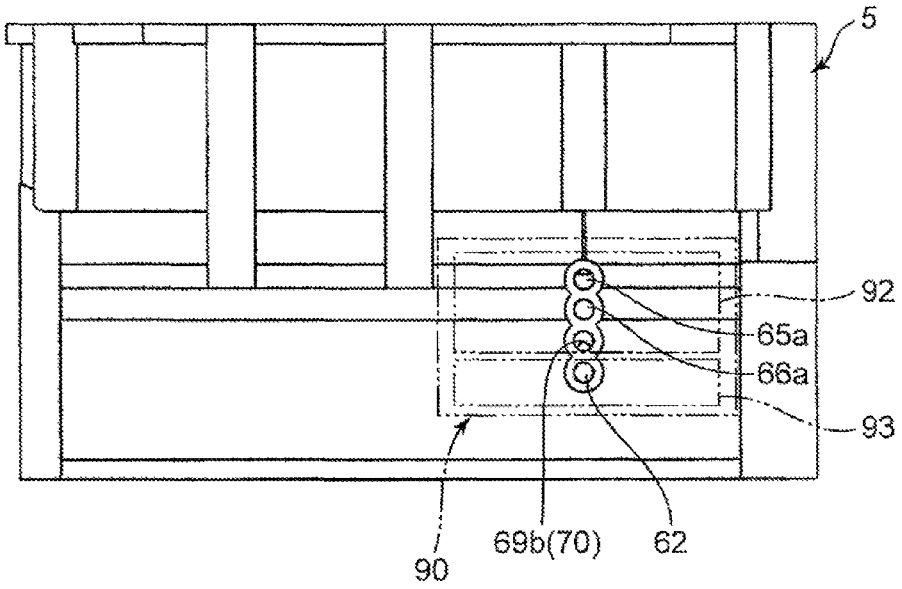
FIG. 11 is a side view of a cylinder block.

As shown in FIGS. 10 and 11, two oil control valves, namely, first and second oil control valves 92 and 93 are housed in the OVC unit 90. While schematically shown, the first oil control valve 92 is connected to the first sub gallery 65 and the second sub gallery 66 via relay oil paths 65*a* and 66*a* respectively formed in the cylinder block 5 and connected to the main gallery 64 via the relay oil path 70 and the second supply oil path 68B. Meanwhile, the second oil control valve 93 is connected to the main gallery 64 via the relay oil path 70 and connected to the oil path 62 (an oil path for supplying oil to control a discharge amount of the oil pump 56) which is formed in the cylinder block 5. Accordingly, the main gallery 64 respectively communicates with the first sub gallery 65 and the second sub gallery 66 via the relay oil path 70, the first oil control valve 92, and the relay ad paths 65*a* and 66*a* and communicates with the oil path 62 via the relay oil path 70 and the second oil control valve 93. Moreover, in the present example, the relay oil path 70 corresponds to the first relay oil path according to the present invention and the relay oil paths 65*a* and 66*a* correspond to the second relay oil path according to the present invention.

As shown in FIGS. 1 and 8, the first crank chamber 53A to the fourth crank chamber 53D which correspond to the respective cylinders #1 to #4 are formed between the block-side supporting sections 51A to 51E that are adjacent to each other in the cylinder block 5. As described earlier, as shown in FIGS. 1 and 5, the nozzles 28*a* of the oil jets 28 for piston cooling are fixed in ceiling portions of the respective crank chambers 53A to 53D at positions below the main gallery 64, and the respective nozzles 28*a* are connected to the main gallery 64. In addition, the nozzles 29*a* of the oil jets 29 for piston lubrication are fixed in ceiling portions of the respective crank chambers 53A to 53D at positions below the second sub gallery 66, and the respective nozzles 29*a* are connected to the second sub gallery 66.

As shown in FIGS. 1, 7, and 8, the nozzles 28*a* and 29*a* of the respective oil jets 28 and 29 are provided so that the nozzles 28*a* and 29*a* extend from positions outside the cylinder bore 8 toward an inner side of the cylinder block 5 to positions below the cylinder bore 8 in a state where the nozzles 28*a* and 29*a* approximately follow the ceiling portions of the respective crank chambers 53A to 53D and that tips of the nozzles are directed toward the piston 9.

As shown in FIGS. 5 and 6, the engine main body further includes an oil path 72 which branches from an end section on a side of the first cylinder #1 of the main gallery 64 of the cylinder block 5 and which extends to the cylinder head 4. The oil path 72 is for supplying operating oil to the VVT described earlier.

In addition, the engine main body includes a branch oil path 73 which branches from an end section on a side of the first cylinder #1 of the first sub gallery 65 and which extends to the cylinder head 4. An oil path 74 which extends in the cylinder head 4 in a width direction thereof is connected to the branch oil path 73. An oil path 75 which extends horizontally in the cylinder bank direction at a prescribed position on an intake side in the cylinder head 4 and an oil path 76 which extends horizontally in the cylinder bank direction at a prescribed position on an exhaust side in the cylinder head 4 branch from the oil path 74. Among the oil paths 75 and 76, the intake-side HLA 24 communicates with the intake-side oil path 75, and a nozzle of an oil supply section (not shown) for lubricating a cam journal of the intake-side cam shaft 20 communicates with the intake-side oil path 75 via the branch oil path 75*a*. In a similar manner, the exhaust-side HLA 24 communicates with the exhaust-side oil path 76, and a nozzle of an oil supply section (not shown) for lubricating a cam journal of the exhaust-side cam shaft 21 communicates with the exhaust-side oil path 76 via the branch oil path 76*a*.

An upper end of the branch oil path 73 of the first sub gallery 65 extends to the earn cap 3, and the nozzle 30*a* of the oil supply section 30 which supplies lubricating oil to the intake-side swing arm 22 and the nozzle 31*a* of the oil supply section 31 which supplies lubricating oil to the exhaust-side swing arm 23 respectively communicate with the branch oil path 73 via oil paths (not shown).

In addition, an oil pressure sensor 80 which detects oil pressure of the main gallery 64 is connected to a vicinity of an end section of the main gallery 64 on the side of the first cylinder #1, and a signal in accordance to the oil pressure of the main gallery 64 is output to a controller 100 (to be described later) by the oil pressure sensor 80 during driving of the engine 2.

Moreover, although not illustrated, lubricating oil and cooling oil which are supplied to the cam journals that rotatably support the cam shafts 20 and 21, the bearing metals 44A to 44E that rotatably support the crank shall 12, the piston 9, the cam shafts 20 and 21, and the like drip down to the oil pan 7 through a drain oil path (not shown) after cooling or lubrication is completed and are once again recirculated by the oil pump 56.

Operations of the engine 2 such as those described above are controlled by the controller 100. The controller 100 is a known microcomputer-based control apparatus and integrally controls oil pressure inside the oil supply path 60. Detection information from various sensors that detect operation states of the engine 2 is input to the controller 100. For example, in addition to the oil pressure sensor 80, the engine 2 is provided with a crank angle sensor 81 which detects a rotation angle of the crank shaft 12, an air flow sensor 82 which detects an amount of air sucked in by the engine 2, an oil temperature sensor 83 which detects an oil temperature inside the oil supply path 60, a cam angle sensor 84 which detects rotation phases of the cam shafts 20 and 21, and a water temperature sensor 85 which detects temperature of cooling water in the engine 2, and detection information from these sensors 80 to 85 is input to the controller 100. The controller 100 detects an engine rotational speed based on detection information of the crank angle sensor 81, detects an engine load based on detection information of the air flow sensor 82, and detects an operating angle of the VVT based on detection information of the cam angle sensor 84.

Based on detection information from the respective sensors 80 to 85, the controller 100 determines an operation state of the engine 2, sets target oil pressure of the oil pump 56 based on a control map stored in advance, and controls oil pressure in the oil supply path 60 based on the target oil pressure.

More specifically, the oil supply apparatus 1 supplies oil to a plurality of hydraulic operating sections (the VVT, the HLAs 24, the oil jets 28 and 29, the oil supply sections 30 and 31, and the like) using one oil pump 56. Required oil pressure of the respective hydraulic operating sections changes in accordance with an operation state of the engine 2. Therefore, for all hydraulic operating sections to obtain necessary oil pressure in all operation states of the engine 2, it is rational to set, for each operation state of the engine 2, oil pressure equal to or higher than highest required oil pressure of the required oil pressure of the respective hydraulic operating sections as target oil pressure in accordance with the operation state of the engine 2. In order to do so, target oil pressure may be set so as to satisfy required oil pressure of oil supply sections (in other words, the second supply oil path 68B and the fourth supply oil path 68D) responsible for hydraulic operating sections with relatively high required oil pressure among all hydraulic operating sections which, in the present embodiment, are the VVT, the oil jets 28 and 29, and the second and fourth bearing metals 44B and 44D (the second and fourth beating: sections 50B and 50D), in which case an oil discharge amount of the oil pump 56 may be controlled based on the target oil pressure. Target oil pressure set in this manner naturally satisfies required oil pressure of other hydraulic operating sections with relatively low required oil pressure.

Although not illustrated, in the present embodiment, for each operation state of the engine 2, an oil pressure control map in which target oil pressure of the operation state is set based on highest required oil pressure of the required oil pressure of the oil supply sections and the like responsible for the VVT, the oil jets 28 and 29, and the second and fourth bearing metals 44B and 44D is stored in a storage section of the controller 100. The controller 100 performs oil pressure feedback control in which a discharge amount of the oil pump 56 is controlled by an operation of the second oil control valve 93 so that oil pressure (actual oil pressure) of the main gallery 64 as detected by the oil pressure sensor 80 equals the target oil pressure.

Moreover, the first oil control valve 92 single-handedly controls oil flow rates with respect to the first sub gallery 65 and the second sub gallery 66 in an interlocked manner. By controlling the first oil control valve 92 in accordance with an operation state of the engine 2, the controller 100 controls oil pressure that is supplied from the first sub gallery 65 to the first bearing metal 44A, the third bearing metal 44C, and the fifth bearing metal 44E through the first supply of path 68A, the third supply oil path 68C, and the fifth supply oil path 68E, and the controller 100 controls an oil flow rate with respect to the second sub gallery 66 to turn on/off oil injection by the oil jet 29 for piston lubrication.

Figure 12:
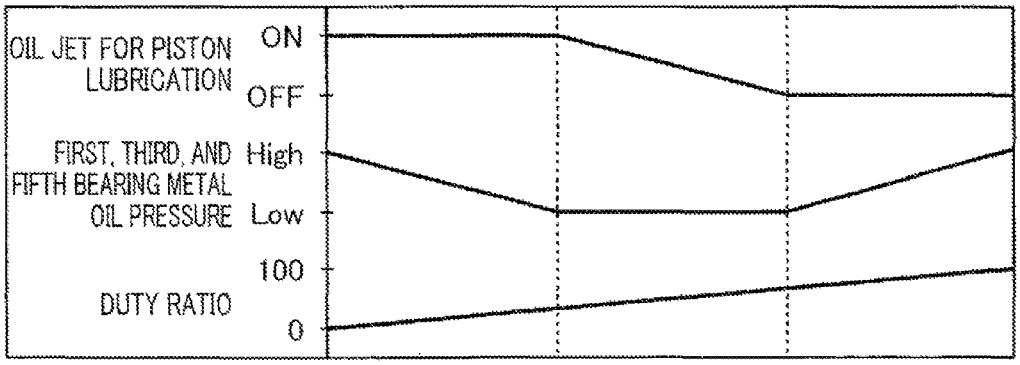
FIG. 12 is a diagram showing characteristics of a first oil control valve.

The first oil control valve 92 is constituted by, for example, a linear solenoid valve, and by transmitting a duty ratio control signal to the first oil control valve 92, the controller 100 controls an oil supply amount to the respective bearing metals 44A to 44E, on/off states of the oil jet 28, and the like as shown in FIG. 12. In addition, the second oil control valve 93 is similarly constituted by, for example, a linear solenoid valve, and by transmitting a duty ratio control signal to the second oil control valve 93, the controller 100 controls an oil supply amount by the oil pump 56.

<Operational Advantage of the Oil Supply Apparatus 1>

In the oil supply apparatus 1 described above, oil discharged from the oil pump 56 is filtered, by the oil filter 58, cooled by the oil cooler 59, and introduced to the main gallery 64 in the cylinder block 5 through the oil path 61. Subsequently, a part of the oil is injected from the nozzle 28*a* of the oil jet 28 for cooling the piston 9, and another pan of the oil is supplied to the second bearing section 50B and the fourth bearing section 50D of the crank shaft 12 through the second supply oil path 68B and the fourth supply oil path 68D. In addition, oil in the main gallery 64 is introduced from the second supply oil path 68B to the first sub gallery 65 and the second sub gallery 66 through the relay oil path 70, the first oil control valve 92, and the relay oil paths 65*a* and 66*a* and, at the same time, supplied to the VVT through the oil path 72 that branches from the main gallery 64.

The oil introduced to the first sub gallery 65 is supplied to the first bearing section 50A, the third bearing section 50C, and the fifth bearing section 50E of the crank shaft 12 through the first supply oil path 68A, the third supply oil path 68C, and the fifth supply oil path 68E. In addition, a part of the oil introduced, to the first sub gallery 65 is introduced to the cylinder head 4 through the branch oil path 73 that branches from the first sub gallery 65 and further supplied to the HLAs 24 through the oil paths 75 and 76 and, at the same time, supplied to cam journal portions of the cam shafts 20 and 21 through branch oil paths 75*a* and 76*a* which respectively branch from the oil paths 75 and 76. Furthermore, the oil is supplied from the respective nozzles 30*a* and 31*a* of the oil supply sections 30 and 31 to the swing arms 22 and 23 through the branch oil path 73.

The oil introduced to the second sub gallery 66 is injected from the nozzle 29*a* of the oil jet 29 to lubricate the piston 9.

In the oil supply apparatus 1, the first sub gallery 65 and the second sub gallery 66 respectively extending in the cylinder bank direction are provided on one side section (exhaust side) of the cylinder bore 8 of the cylinder block 5. The following advantages are gained due to the first sub gallery 65 for supplying oil to the crank shaft 12 (the first, third, and fifth bearing sections 50A, 50C, and 50E) being provided on an inner side or, in other words, a side of the cylinder bore 8 and the second sub gallery 66 for supplying oil to the oil jet 29 being provided on an outer side of the first sub gallery 65.

First, as shown in FIGS. 9 and 10, due to the first sub gallery 65 being provided on the side of the cylinder bore 8, the supply oil paths 68A, 68C, and 68E which branch from the first sub gallery 65 can be provided near the cylinder bore 8. As a result, the screw hole 55 for fixing the bearing caps 52A, 52C, and 52E to the block-side supporting sections 51A, 51C, and 51E can be provided with room to spare at a position separated from the supply oil paths 68A, 68C, and 68E on an outer side (a side separated from the cylinder bore 8). Normally, the screw hole 55 and the supply oil paths 68A, 68C, and 68E are processed after the cylinder block 5 is molded as a casting of aluminum alloy or the like. However, since the screw hole 55 can be provided with room as described above, processing errors such as mistakenly making the screw hole 55 and the supply oil paths 68A, 68C, and 68E communicate with each other can be prevented in advance.

In addition, due to the second sub gallery 66 being provided on an outer side of the first sub gallery 65, the nozzle 29*a* of the oil jet 29 which is connected thereto can be given a shape which extends approximately along the ceiling surface of the crank chamber 53 and which has little shape variation in a vertical direction as described above (refer to FIG. 1). Therefore, the nozzle 29*a* can be arranged in a compact manner while avoiding interference between the crank webs 42 (42A to 42D) of the crank shaft 12 and the nozzle 29*a* in the confined crank chambers 53 (53A to 53D).

Furthermore, according to the configuration of the oil supply apparatus 1 described above, the main gallery 64 is provided at a position on an opposite side to the first sub gallery 65 relative to the cylinder bore 8, and oil is supplied to bearing sections other than the first, third, and fifth bearing sections 50A, 50C, and 50E of the crank shaft 12 or, in other words, the second bearing section 50B and the fourth bearing section 50D through the second supply oil path 68B and the fourth supply oil path 68D which branch from the main gallery 64. According to this configuration, since oil with relatively high pressure can be supplied to the second bearing section 50B and the fourth bearing section 50D from the oil pump 56, oil can also be supplied to the second and fourth bearing sections 50B and 50D without excess or deficiency while supplying appropriate amounts of oil to the respective crank pins 43A to 43D of the crank shaft 12. On the other hand, excessive supply of oil to the first, third, and fifth bearing sections 50A, 50C, and 50E can be prevented by supplying oil with relatively low pressure through the supply oil paths 68A, 68C, and 68E which branch from the first sub gallery 65 and, accordingly, appropriate amounts of oil can be supplied without excess or deficiency. Therefore, according to the oil supply apparatus 1, an advantage in that the crank shaft can be lubricated in a favorable manner can also be gained.

While the cylinder block 5 applied to the oil supply apparatus 1 described above is, for example, cast using aluminum alloy or the like as a material, die-cast molding using a die has become mainstream in recent years. To provide a simple overview, a die having a cavity corresponding to the cylinder block 5 is prepared (preparation step), molten metal made of a metal material such as aluminum alloy is poured into the cavity of the die to mold a cylinder block (molding step). In this case, the respective galleries 64 to 66 are molded using core pins fixed to the die main body in advance. Subsequently, after die opening, by performing post-processing such as punching and tapping on the cylinder block (post-processing step), the cylinder block 5 as a product is completed.

In such die-cast molding of the cylinder block 5, in the molding step, molten metal is desirably poured into the cavity at a position which is an end section of the die on a side of the main gallery 64 in the width direction of the cylinder block 5 and which corresponds to a lower end section of a side wall (a skirt section lower end) of the crank chambers 53 (53A to 53D). In the cylinder block 5, for example, this position is a position indicated by an arrow in FIG. 10.

According to this method, since molten metal is poured into the cavity from a side of the cavity which has a smaller number of core pins for molding the oil paths (the main oil supply path, the first sub oil supply path, and the second sub oil supply path), a course of the molten metal is less likely to be obstructed by the core pins and running property is improved. Therefore, occurrences of blowholes can be suppressed and manufacturing yield of cylinder blocks can be effectively improved.

<Other Configurations>

The oil supply apparatus 1 described above is an example of a preferred embodiment of the engine oil supply apparatus according to the present invention and a specific configuration thereof can be modified as appropriate without departing from the gist of the present invention.

For example, the VVT, the HLAs 24, the oil jets 28 and 29, the oil supply sections 30 and 31, and the like connected to the oil supply path 60 are examples of hydraulic operating sections according to the present invention and specific types of hydraulic operating sections and specific connection positions of the hydraulic operating sections on the oil supply path 60 are not limited to those in the embodiment described above.

In addition, while a pump that is driven by the engine 2 is applied as the oil pump 56 in the embodiment described above, the oil pump 56 may alternatively be driven by an electric motor.

Furthermore, while an example in which the present invention is applied to an in-line four-cylinder gasoline engine is described in the embodiment presented above, the present invention can also be applied to other engines such as a diesel engine.

The present invention described above can be summarized as follows.

Specifically, the present invention is an engine oil supply apparatus including: a cylinder block including a plurality of journal supporting wall sections which are aligned in a cylinder bank direction and each of which supports a crank journal of a crank shaft and a cylinder communicating with a crank chamber formed between the journal supporting wall sections that are adjacent to each other; a shaft supporting member which is assembled to the journal supporting wall section and which bears the crank journal of the crank shaft in cooperation with the journal supporting wall section; and a nozzle which is fixed to a ceiling portion of the crank chamber and which injects oil to a piston that slides inside the cylinder, wherein the cylinder block includes a first oil supply path which extends in the cylinder bank direction at a position of one side section of the cylinder in a width direction that is perpendicular to the cylinder bank direction, a branch oil path which branches from the first oil supply path at a position of the journal supporting wall section and which supplies oil to a crank bearing section by which the crank journal is borne, and a second oil supply path which extends in the cylinder bank direction at a position further outward than the first oil supply path in the width direction and which supplies oil to the nozzle.

According to this configuration, since the first oil supply path for supplying oil to the crank bearing section (branch oil path) is provided on a side closer to the cylinder than the second oil supply path in the width direction of the cylinder block, the branch oil path which branches from the first oil supply path can be provided closer to the cylinder. Therefore, since hole sections for fixing such as the screw hole used to assemble the shaft supporting member to the journal supporting wall section can be provided on an outer side (a side separating from the cylinder) of the branch oil path with room to spare, processing errors during processing of the branch oil path and the fixing holes such as mistakenly making the branch oil path and the fixing holes communicate with each other can be prevented in advance. In addition, since the nozzle can be formed so as to face the inside of the cylinder approximately along the ceiling surface of the crank chamber due to the second oil supply path for supplying oil to the nozzle being provided at a position separated from the cylinder, the nozzle can be arranged in a compact manner in the ceiling portion of the crank chamber while avoiding interference with the crank shaft and, in particular, interference with the crank web (crank weight).

In the oil supply apparatus, preferably, the crank shaft includes a plurality of crank journals and oil is introduced into the crank shaft from a specific crank journal from among the plurality of crank journals and supplied to a crank pin through an inside passage formed in the crank shalt when the first oil supply path and the second oil supply path are respectively defined as a first sub oil supply path and a second sub oil supply path and the branch oil path is defined as a first branch oil path, the cylinder block includes a main oil supply path which extends in the cylinder bank direction at a position on an opposite side to the first sub oil supply path in the width direction, with the cylinder as center, and to which oil discharged from an oil pump is introduced, and a second branch oil path which branches from the main oil supply path at a position of the journal supporting wall section and which supplies oil to the crank bearing section by which the specific crank journal is borne, the first sub oil supply path and the second sub oil supply path are connected to a downstream side of the main oil supply path in an oil flow direction, and the first branch oil path supplies oil to the crank bearing section of the crank journal other than the specific crank journal.

According to this configuration, appropriate amounts of oil can be favorably supplied to the respective crank journals and crank pins of the crank shaft. In addition, since the main oil supply path and the sub oil supply paths are separated from each other on both sides of the cylinder, occurrences of blowholes such as the oil paths mistakenly being connected to each other can be suppressed during manufacturing (during molding) of the cylinder block.

In this case, preferably, the oil supply apparatus includes a relay oil path which is an oil supply path for making the first sub oil supply path or the second sub oil supply path communicate with the main oil supply path, and which is formed on a journal supporting wall section, on which the second branch oil path is formed, among the plurality of journal supporting wall sections, and moreover which is connected to the second branch oil path.

According to this configuration, the main oil supply path and the first sub oil supply path or the second sub oil supply path can communicate with each other in a rational manner using a journal supporting wall section without the first branch oil path among the plurality of journal supporting wall sections or using the second branch oil path.

In this case, preferably, when the relay oil path is defined as a first relay oil path, the oil supply apparatus includes an oil control valve which is fixed to a side surface of the cylinder block in the width direction and a second relay oil path which is formed on the journal supporting wall section and which makes the first sub oil supply path or the second sub oil supply path communicate with the oil control valve, and the first relay oil path is formed so as to communicate with the oil control valve.

According to this configuration, since the first and second relay oil paths can be given relatively simple shapes which open on the side surface of the cylinder block in addition to being able to make the main oil supply path communicate with the first sub oil supply path or the second sub oil supply path via the oil control valve, productivity of the cylinder block is improved.

In addition, the present invention is a method of manufacturing the cylinder block used in the oil supply apparatus described above, the method including: a preparation step for preparing a die having a cavity corresponding to the cylinder block; and a molding step for molding the cylinder block by pouring molten metal made of a metal material into the cavity of the die, wherein in the molding step, the molten metal is poured into the cavity from a position which is an end section of the die on the side of the main oil supply path in the width direction of the cylinder block and which corresponds to a lower end section of a side wall of the crank chamber.

According to this method, since molten metal is poured into the cavity from a side of the cavity which has a smaller number of dies (core pins) for forming the oil paths (the main oil supply path, the first sub oil supply path, and the second sub oil supply path), running property can be improved and occurrences of blowholes can be suppressed.

The invention claimed is:

1. An engine oil supply apparatus, comprising: a cylinder block including a plurality of journal supporting wall sections which are aligned in a cylinder bank direction and each of which supports a crank journal of a crank shaft and a cylinder communicating with a crank chamber formed between the journal supporting wall sections that are adjacent to each other; a shaft supporting member which is assembled to the journal supporting wall section and which bears the crank journal of the crank shaft in cooperation with the journal supporting wall section; and a nozzle which is fixed to a ceiling portion of the crank chamber and which injects oil to a piston that slides inside the cylinder, wherein the cylinder block includes a first oil supply path which extends in the cylinder bank direction at a position of one side section of the cylinder in a width direction that is perpendicular to the cylinder bank direction, a branch oil path which branches from the first oil supply path at a position of the journal supporting wall section and which supplies oil to a crank bearing section by which the crank journal is borne, and a second oil supply path which extends in the cylinder bank direction at a position further outward than the first oil supply path in the width direction and which supplies oil to the nozzle, the crank shaft includes a plurality of crank journals and oil is introduced into the crank shaft from a specific crank journal from among the plurality of crank journals and supplied to a crank pin through an inside passage formed in the crank shaft, when the first oil supply path and the second oil supply path are respectively defined as a first sub oil supply path and a second sub oil supply path and the branch oil path is defined as a first branch oil path, the cylinder block includes a main oil supply path which extends in the cylinder bank direction at a position on an opposite side to the first sub oil supply path in the width direction, with the cylinder as center, and to which oil discharged from an oil pump is introduced, and a second branch oil path which branches from the main oil supply path at the position on the opposite side to the first sub oil supply path in the width direction, with the cylinder as center, and at a position of the journal supporting wall section and which supplies oil to the crank bearing section by which the specific crank journal is borne, the first sub oil supply path and the second sub oil supply path are connected to a downstream side of the main oil supply path in an oil flow direction, the first branch oil path supplies oil to the crank bearing section of the crank journal other than the specific crank journal, and an oil control valve for controlling respective oil flow rates in the first sub oil supply path and the second sub oil supply path in accordance with an operation state of the engine is disposed on the cylinder block at the position of one side section of the cylinder.

2. The engine oil supply apparatus according to claim 1, further comprising:

a relay oil path which is an oil supply path for making the first sub oil supply path or the second sub oil supply path communicate with the main oil supply path, and which is formed on a journal supporting wall section, on which the second branch oil path is formed, among the plurality of journal supporting wall sections, and moreover which is connected to the second branch oil path.

3. The engine oil supply apparatus according to claim 2, wherein when the relay oil path is defined as a first relay oil path, the oil supply apparatus includes the oil control valve and a second relay oil path which is formed on the journal supporting wall section and which makes the first sub oil supply path or the second sub oil supply path communicate the oil control valve, and the first relay oil path is formed so as to communicate with the oil control valve.

4. A method of manufacturing the cylinder block used in the engine oil supply apparatus according to claim 1, the method comprising:

a preparation step for preparing a die having a cavity corresponding to the cylinder block; and a molding step for molding the cylinder block by pouring molten metal made of a metal material into the cavity of the die, wherein in the molding step, the molten metal is poured into the cavity from a position which is an end section of the die on the side of the main oil supply path in the width direction of the cylinder block and which corresponds to a lower end section of a side wall of the crank chamber.

5. The engine oil supply apparatus according to claim 1, wherein the oil control valve is constituted by a linear solenoid valve, and controls, by means of a duty ratio control signal, an oil flow rate with respect to the crank bearing section of the crank journal other than the specific crank journal and an oil flow rate with respect to the nozzle.

6. The engine oil supply apparatus according to claim 1, wherein when the oil control valve is defined as a first oil control valve, the oil pump which is connected to the main oil supply path and whose discharge amount can be controlled;

said engine oil supply apparatus further comprising:

an oil pressure sensor which detects an oil pressure in the main oil supply path;

a plurality of hydraulic operating sections connected to the main oil supply path, the first sub oil supply path and the second sub oil supply path, respectively, and a second oil control valve which sets, as a target oil pressure, one of required oil pressures required by the plurality of hydraulic operating sections that corresponds to the operation state of the engine, and controls the discharge amount of the oil pump so that an oil pressure detected by the oil pressure sensor equals the target oil pressure.

* * * * *